United States Patent [19]

Hula

[11] 4,395,044

[45] Jul. 26, 1983

[54] SPACE BOARD GAME APPARATUS

[76] Inventor: Carl J. Hula, 9021 Forest Dr., Hickory Hills, Ill. 60457

[21] Appl. No.: 278,341

[22] Filed: Jul. 2, 1981

[51] Int. Cl.[3] ..... A63F 3/00

[52] U.S. Cl. ..... 273/253; 273/287

[58] Field of Search ..... 273/287, 243, 253, 256, 273/254, 236, 251, 252

[56] References Cited

U.S. PATENT DOCUMENTS

| | | | |
|---|---|---|---|
| 3,506,268 | 4/1970 | Stadler | 273/256 X |
| 3,709,497 | 1/1973 | Barlow | 273/236 X |
| 3,865,381 | 2/1975 | Hayes | 273/287 X |
| 3,871,659 | 3/1975 | Breslow et al. | 273/287 X |
| 4,061,335 | 12/1977 | Breslow | 273/243 |
| 4,067,576 | 1/1978 | Balos et al. | 273/282 |
| 4,244,579 | 1/1981 | Campos | 273/243 |

OTHER PUBLICATIONS

*Games and Puzzles Magazine* "The Bermuda Triangle" p. 28, 9/1977.

*Primary Examiner*—Richard C. Pinkham
*Assistant Examiner*—Scott L. Brown
*Attorney, Agent, or Firm*—Dressler, Goldsmith, Shore, Sutker & Milnamow, Ltd.

[57] ABSTRACT

A board game apparatus is provided in which a playing board has marked spaces defining a playing path. The spaces have assigned values. Penalties and rewards are provided to the players according to their position on the playing path. A first chance member is operable by the players for determining the number of spaces to be traversed by a playing token. A second chance member is associated with one of the spaces. The second chance member comprises an upstanding member defining a plurality of generally vertical apertures. One or more of the apertures are adapted to be plugged and closed, and an insert is receivable in the apertures. A player whose token is moved to the second chance member is required to place one of the inserts into one of the apertures, with at least one of the apertures being closed by one of the plugs. If the insert falls completely through an unplugged aperture, the player is permitted to continue in the game. If the insert remains in a plugged aperture, the player is penalized, as by being eliminated from the game.

9 Claims, 11 Drawing Figures

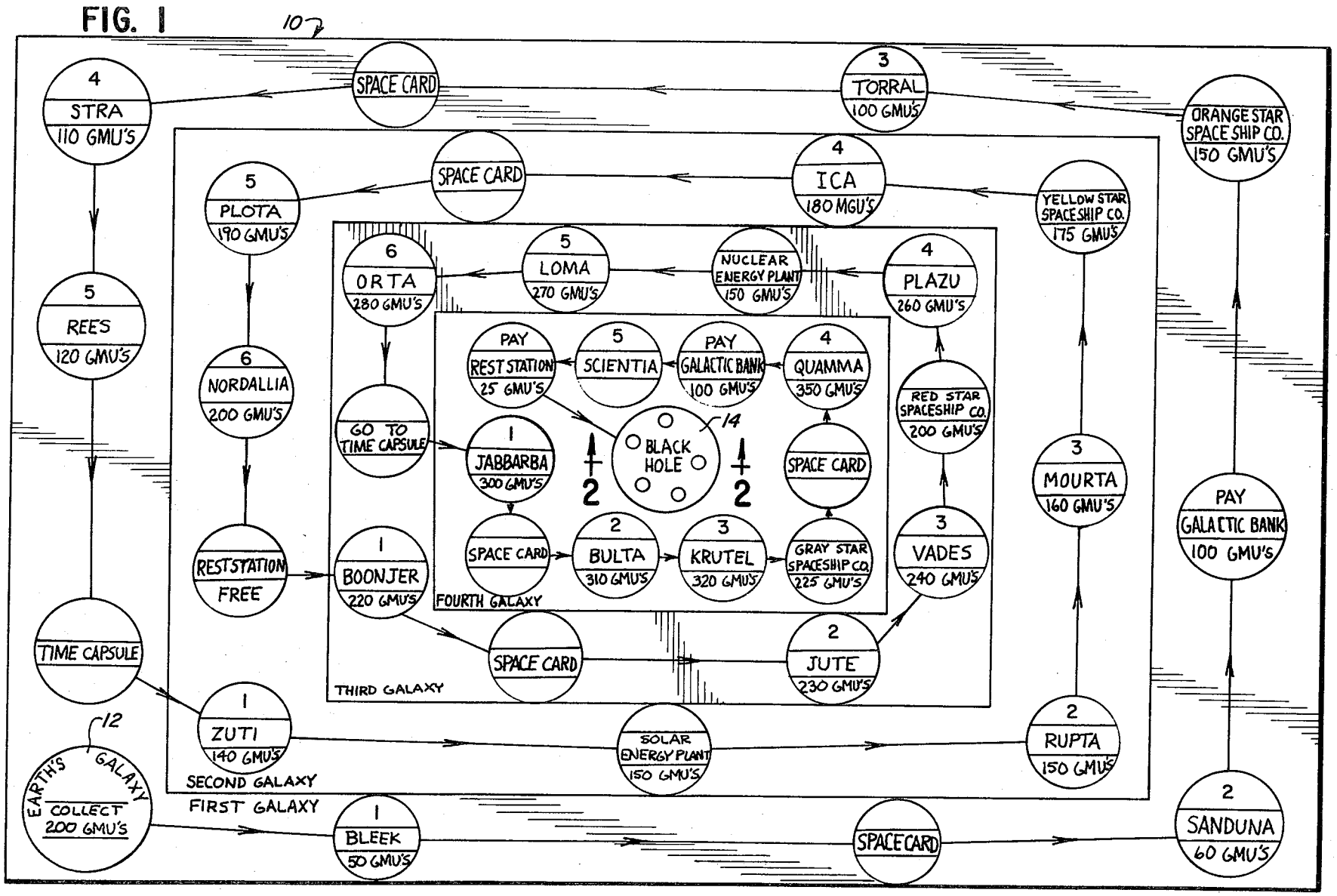
FIG. 1
10
ORANGE STAR SPACE SHIP CO. 150 GMU'S
PAY GALACTIC BANK 100 GMU'S
2 SANDUNA 60 GMU'S
YELLOW STAR SPACE SHIP CO. 175 GMU'S
3 MOURTA 160 GMU'S
2 RUPTA 150 GMU'S
3 TORRAL 100 GMU'S
4 ICA 180 MGU'S
4 PLAZU 260 GMU'S
RED STAR SPACE SHIP CO. 200 GMU'S
3 VADES 240 GMU'S
SPACE CARD
4 QUAMMA 350 GMU'S
SPACE CARD
GRAY STAR SPACE SHIP CO. 225 GMU'S
2 JUTE 230 GMU'S
NUCLEAR ENERGY PLANT 150 GMU'S
PAY GALACTIC BANK 100 GMU'S
14
BLACK HOLE
3 KRUTEL 320 GMU'S
SOLAR ENERGY PLANT 150 GMU'S
5 LOMA 270 GMU'S
5 SCIENTIA
2 BULTA 310 GMU'S
PAY REST STATION 25 GMU'S
1 JABBARBA 300 GMU'S
SPACE CARD
SPACE CARD
SPACE CARD
SPACE CARD
6 ORTA 280 GMU'S
GO TO TIME CAPSULE
1 BOONJER 220 GMU'S
FOURTH GALAXY
THIRD GALAXY
1 BLEEK 50 GMU'S
5 PLOTA 190 GMU'S
6 NORDALLIA 200 GMU'S
REST STATION FREE
1 ZUTI 140 GMU'S
SECOND GALAXY
FIRST GALAXY
4 STRA 110 GMU'S
5 REES 120 GMU'S
TIME CAPSULE
12
EARTH'S GALAXY COLLECT 200 GMU'S FIG. 3
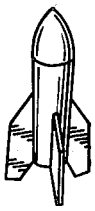
FIG. 6
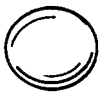
FIG. 11
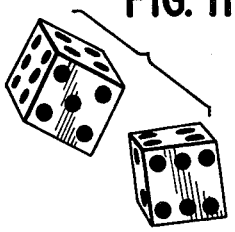
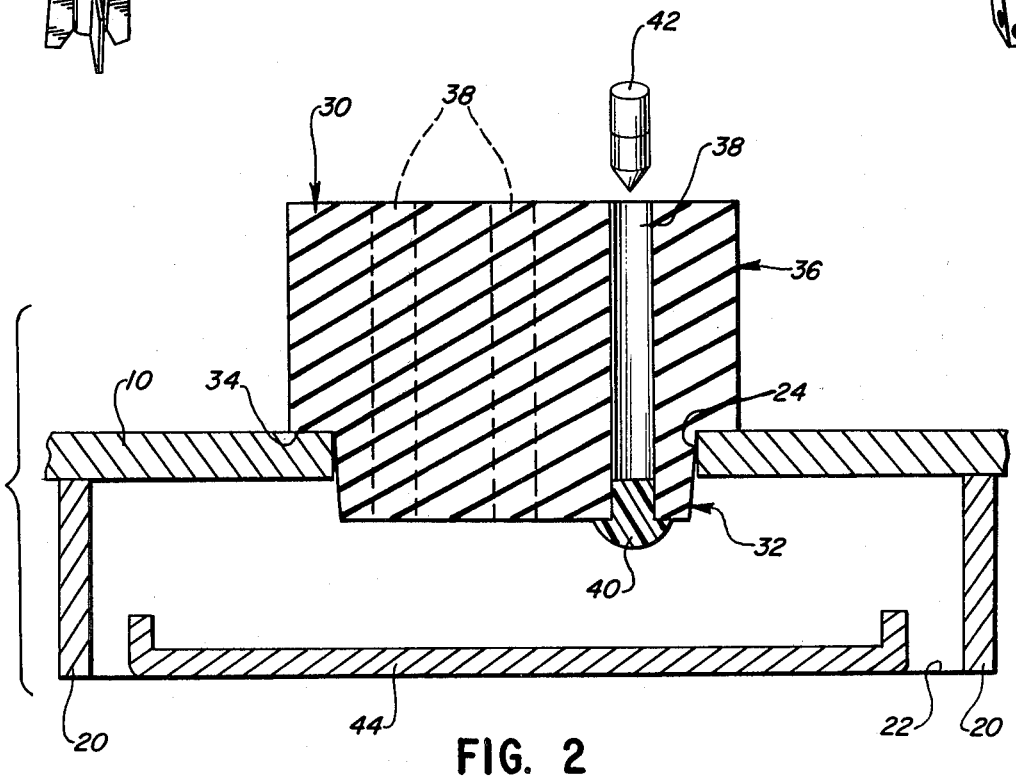
FIG. 2
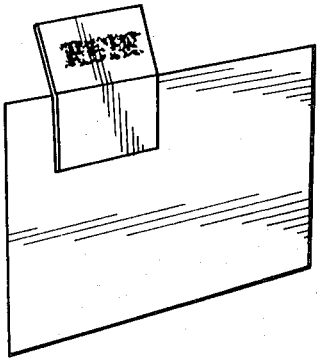
FIG. 10
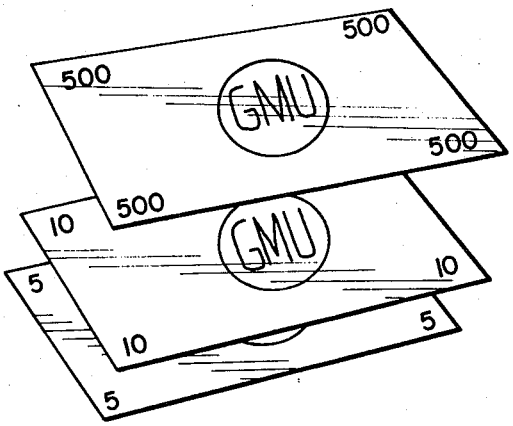
FIG. 4

FIG. 5

TITLE CARDS

TITLE CARD

RED STAR SPACE SHIP CO.

LANDING COST 30 GMUs

IF MORE THAN ONE SPACE SHIP CO. IS OWNED, THE LANDER PAYS TOTAL OF ALL COMPANIES OWNED.

TITLE CARD

SOLAR ENERGY SPACE PLANT

LANDING COST 30 GMUs

IF BOTH ENERGY PLANTS ARE OWNED, THE LANDING COST IS 90 GMUs.

PLANET TITLE CARD

ORTA

| | | |
|---|---|---|
| LANDING COST | | 25 GMUs |
| WITH COLONIES | Gold | 120 GMUs |
| WITH CITIES | Green | 360 GMUs |
| WITH PROVINCES | Blue | 1080 GMUs |
| WITH FORTRESS | White | 1375 GMUs |

EXPANSION COST IS 175 GMUs

Orta is a dreary planet with little vegetation, and the sun only shines four hours per day. However, the planet contains ten enormous oil oceans containing enough oil to maintain universal supplies for thousands of years. The oceans are inhabited by Geeks, 30' tall monsters that resemble giant black frogs. They sleep 20 hours a day and surface only during the four daylight hours.

*SIDE 1*

| ROLL | SPECIAL ROLL INSTRUCTIONS |
|---|---|
| 2 | Geeks destroy oil dericks; repairs cost 200 GMUs. |
| 3 | Attempts to manufacture artificial sunlight fail. Repay investor fee of 50 GMUs to each player. |
| 4 | Discover Geek legs to be excellent delicacies. Each lander pays 50 GMUs for "take-out" Geek legs. |
| 5-9 | Okay to build. |
| 10 | Decrease in Geek population allows for increased oil production. Receive 100 GMU profit from bank. |
| 11 | Lack of sunlight discourages visitors. Decrease landing cost by one-half original. |
| 12 | Orta wins intergalactic oil contract; double original landing costs. Future roll of 11 is void. |

*SIDE 2*

PLANET TITLE CARD

ZUTI

| | | |
|---|---|---|
| LANDING COST | | 10 GMUs |
| WITH COLONIES | Gold | 50 GMUs |
| WITH CITIES | Green | 150 GMUs |
| WITH PRIVINCES | Blue | 450 GMUs |
| WITH FORTRESS | White | 750 GMUs |

EXPANSION COST IS 100 GMUs

Zuti is inhabited by tall (over 7') skinny humanoids with wasp-like heads, minus antennas. These Zutians ride through the air on winged horse-like creatures. Zutians are generally friendly, but they are very protective of the many "seas of nectar" that are their main sustenance.

*SIDE 1*

| ROLL | SPECIAL ROLL INSTRUCTIONS |
|---|---|
| 2 | Space ship pollution damages some "nectar seas." Pollution screens must be build over each sea. Pay 200 GMUs. |
| 3 | Pollution screens built over the "nectar seas" require maintenance; pay 100 GMUs. |
| 4-10 | Okay to build. |
| 11 | To subsidize the cost of pollution screen maintenance for the "nectar seas," charge each lander additional 50 GMUs. |
| 12 | Discover nectar sea ingredients can be used in life-saving medications; receive 500 GMUs research grant from the bank. |

*SIDE 2*

FIG. 7

BLACK HOLE CARDS

Roll the dice. If you throw a 3 or an 11, your space ship disappears forever and you are out of the game. Whoever lands on your planet assumes ownership of planet and colonies. Your money is returned to the bank. Roll any other number, and you return to Earth's Galaxy, but do not collect 200 GMUs.

Roll the dice. An even roll means a safe entry to Earth's Galaxy and you collect 200 GMUs. An odd roll means extensive ship damage. Pay 500 GMUs for repairs and return to Earth's Galaxy. Do not collect 200 GMUs.

Your space ship floats through the black hole and ends up in the time capsule, where you must stay for three turns.

Lose one turn, then roll and proceed as usual.

Your ship receives extensive damage going through the black hole. Pay 50 GMUs for repairs. Return to Earth's Galaxy, but do not collect 200 GMUs.

If you have a beam forward card, you can beam to Earth's Galaxy and collect 200 GMUs. If not, return to Earth's Galaxy and pay 500 GMUs.

FIG. 8

SPACE CARDS

Renew your space ship license; pay 50 GMUs.

Go directly to time capsule.

Safe exit from Black Hole; collect 200 GMUs.

Ship repair; good for 100 GMUs.

FIG. 9

BEAM CARDS

Beam forward.

Beam back.

Super beam in either direction; any number of galaxies.

SPACE BOARD GAME APPARATUS

DESCRIPTION

1. Technical Field of the Invention

The present invention relates to a board game apparatus and, more particularly, to a board game in which first chance means is employed for advancing a playing marker about the game board, and second chance means determines whether or not a player remains in the game.

2. Background of the Invention

Games which involve the ownership of property, the movement of playing markers about a path on a game board, and chance means for rewarding or penalizing a player are the subject of a number of patents.

One of the most popular games involving the ownership of property is the game called "Monopoly" which is disclosed in U.S. Pat. No. 2,026,082. A playing path extends around the periphery of a board, and real estate is purchased, sold, developed and rented in accordance with the rules of the game.

The prior art patents do not disclose a board game having a chance means which can determine in a single move of a player whether or not that player remains in the game. Such a chance means would heighten and increase the suspense in playing the game by providing the ultimate risk that a board game player can incur—whether or not that player will remain in the game, no matter how successful that player might otherwise be under the rules of the game.

The prior art patents also do not disclose a board game apparatus having a plurality of generally concentric playing path segments, wherein a player can travel from one path segment to another.

SUMMARY OF THE INVENTION

In accordance with the present invention, a board game apparatus is provided in which a playing board has marked spaces defining a playing path, with a plurality of the spaces being marked so as to each define a designated space. Means is associated with each of the designated spaces for identifying a value associated therewith.

A plurality of playing tokens is provided for traversing the playing path. Each player of the game apparatus is provided with at least one of the playing tokens.

First chance means is operable by the players for determining the number of spaces to be traversed by one of the playing tokens. A plurality of pieces representing money are allocated to the players before the game commences.

The game apparatus includes means for providing penalties and rewards to a player according to the position of his token on the playing path.

Second chance means is associated with one of the spaces. The second chance means comprises an upstanding member defining a plurality of generally vertical apertures. Means is provided for plugging and closing at least one of the apertures. Insert means is receivable in the apertures. A player whose token is moved to the second chance means is required to place one of the insert means into one of the apertures, with at least one of the apertures being closed by one of the plug means. If the insert means falls completely through an unplugged aperture, the player is permitted to continue in the game. If the insert means remains in a plugged aperture, the player is penalized, as by being eliminated from the game.

In accordance with another feature of the present invention, the marked spaces are positioned in a plurality of generally concentric and continuous path segments. The apparatus further includes means for moving the playing tokens from one path segment to another path segment.

BRIEF DESCRIPTION OF THE DRAWINGS

FIG. 1 is a plan view of a playing board in accordance with the present invention;

FIG. 2 is a fragmentary, enlarged cross-sectional view taken along plane 2—2 in FIG. 1;

FIG. 3 is exemplary of the markers used for traversing the game board of the present invention;

FIG. 4 illustrates simulated money used in playing the game of the present invention;

FIG. 5 is exemplary of the title cards associated with the properties on the playing path of the game board;

FIG. 6 is exemplary of the markers that are used for colonizing the planets on the game board;

FIG. 7 is exemplary of a deck of black hole cards;

FIG. 8 is exemplary of a deck of space cards;

FIG. 9 is exemplary of a deck of beam cards;

FIG. 10 is exemplary of the change clips that are attachable to the title cards and;

FIG. 11 is a perspective view of dice used in playing the game of the present invention.

DESCRIPTION OF THE PREFERRED EMBODIMENT

While this invention is susceptible of embodiment in many different forms, there is shown in the drawings and will herein be described in detail one specific embodiment, with an understanding that the present disclosure is to be considered as an exemplification of the principles of the invention and is not intended to limit the invention to the embodiment illustrated.

Referring to FIG. 1 of the drawings, the board game apparatus of the present invention includes a playing board 10 which is substantially rectangular in configuration and has a playing course composed of a series of interconnected marked spaces, such as the space designated with the numeral 12. The spaces define a playing path. In the illustrated embodiment, the playing path includes four generally rectangular, concentric, path segments that are positioned about a central "black hole" 14. Each path segment includes a plurality of individual spaces that are interconnected by lines, and one of the spaces from each path segment connects with a space from the adjacent path segment that is positioned closer to the center of the playing board.

The path segments represent galaxies in outer space. In the illustrated embodiment, the outermost galaxy is the earth's galaxy or the first galaxy, the adjacent galaxy is the second galaxy, the next-innermost galaxy is the third galaxy, the innermost galaxy is the fourth galaxy, and the "black hole" space 14 is at the center of the playing board.

Each of the four galaxies includes ten spaces, with the first galaxy having an additional starting space 12. In the illustrated embodiment, the ten spaces in each galaxy are designated either as planets, space card positions, space ship company positions or with other indicia indicating associated rewards, penalties, or other instructions. Each galaxy has five or six planet spaces which are numbered one through five or one through six, respectively, one or two space card positions, one space ship company position, and one or two other spaces having associated landing costs and/or instructions.

More specifically, the first galaxy has five planets, a space ship company property space, a galactic bank space, a time capsule space, and two space card positions; the second galaxy includes six planets, a space ship company position, a solar energy plant space, a rest station, and one space card position; the third galaxy has six planets, a space ship company property, a nuclear energy plant property, a "go to time capsule" space, and a space card position; and the fourth galaxy includes five planets, a space ship company property, a galactic bank space, a rest station space, and two space card positions.

A plurality of title cards (FIG. 5) is provided, with one of the title cards being associated with each space that is designated either as a planet or other property, such as the space ship company properties and the energy plant properties. The title cards provide information with respect to the landing cost to be incurred by a player who lands on the space associated with that title card, and can also provide mythical information about the mythical planets.

An exemplary planet title card is shown in FIG. 5 for the planet Zuti, which is the first planet in the second galaxy. The costs that are referred to are in money which is known as "galactic money units" (GMU's), that are illustrated in FIG. 4, and which are provided to the players at the beginning of the game.

On one side of the title card for the planet Zuti, there are instructions which are followed when the player who owns this planet lands thereon. When this occurs, the player who owns the planet rolls the two dice (FIG. 11), and follows the "special roll instructions" on the back of the planet title card. The instructions can provide for rewards, e.g., a roll of twelve entitles the owner of the planet to receive 500 galactic money units from the bank, and a roll of eleven provides for an increased landing cost to players that land on this space in the future.

Some of the instructions provide for penalties, e.g., rolling either a two or a three on the dice requires the owner of the planet to pay money to the bank.

Other instructions entitle the owner of the planet to build or colonize thereon if the roll of the dice is between four and ten. Each time the owner of the planet wishes to build further upon it, he must pay the expansion cost of 100 galactic money units to the bank. If no buildings currently exist on the planet, and the special roll instructions permit the owner to build, the owner can pay the expansion cost that is shown on the title card and build a colony thereon, in which case a gold colored marker (FIG. 6) is placed on the planet, and another player that lands on the planet would be required to pay the landing costs of 50 galactic money units for the colonized planet.

If the player already has a colony on the planet and wishes to build further, he would pay the expansion cost shown on the title card and place a green marker thereon, which increases the landing cost to another player to 150 galactic money units. Similarly, if cities already exist on the planet and the owner of the planet is permitted to build further and wishes to do so, then he would pay the expansion cost and replace the green marker with a blue marker, which increases the landing costs to others to 450 galactic money units. Lastly, if the player who owns the planet already has provinces and is permitted to build further, he can pay the expansion cost and replace the blue marker with a white one to indicate a fortress, which increases the landing costs to others to 750 galactic money units.

On the reverse side of the title card for the planet Zuti, there are instructions for the landing costs incurred by someone who lands on the planet but does not own it. Thus, if a player lands on this planet and the planet is owned by another, a landing cost of 10 galactic money units would be paid to the owner of the planet if it is not colonized. If the planet has colonies, the landing costs would be 50 galactic money units; with cities, the landing cost would be 150 galactic money units; with provinces, the landing cost would 450 galactic money units; and with a fortress, the landing cost would 750 galactic money units.

The special roll instructions for the planet title cards provide some instances for increases or decreases in the landing costs for the planet. Change clips (FIG. 10) are provided for attachment to the title cards for convenient reference. It is the responsibility of the player who owns the title to property for determining that the landing costs, as amended by the change clips, are followed.

Title cards are also provided for the energy plant spaces and for the spaceship company positions on the playing board. There are two energy plant spaces. Each has a landing cost of 30 galactic money units to a player that does not own the title to that energy plant, but the landing cost is increased to 90 galactic money units if both energy plants are owned by the same person.

There is a similar advantage to owning more than one space ship company. If a person owns one space ship company, he collects the designated landing cost if another player lands thereon. However, if a first player owns more than one space ship company, a second player who lands on one of those space ship companies pays the total landing costs for all of the space ship companies that are owned by the first person.

The "black hole" space 14 is a particular feature of the present invention which may cause a player to lose the game, or can strategically increase his odds of winning the game. As shown in FIG. 2, the preferred embodiment of the present invention includes spacer blocks 20 that rest on a surface 22 such as a table top and are positioned beneath the playing board 10 so that the playing board is spaced above the surface 22. The playing board 10 defines an opening 24 in the position of the "black hole" space.

The "black hole" device 30 is receivable in the opening 24 and is removable therefrom. As illustrated, the "black hole" device 30 can comprise a cylinder having a tapered portion 32 with a diameter less than the inside diameter of the opening 24, so that the tapered lower portion 32 is disposed below the playing board 10. The "black hole" device also has an outwardly extending shoulder portion 34 which engages a marginal portion of the playing board around the opening 24 for supporting the "black hole" device. The "black hole" device further includes a cylindrical upstanding portion 36 having a predetermined height.

The "black hole" device 30 may comprise an integral member formed of plastic or other suitable materials and defines a plurality of generally vertical through apertures 38, with five apertures being preferred, as illustrated in FIG. 1. Plug means 40 is provided for closing at least one of the apertures, and preferably is receivable in the bottom end of the aperture and releasably secured thereto by frictional engagement. Insert means 42 is receivable in one of the apertures. All of the apertures preferably have the same inside diameter and the insert means has a smaller outside diameter.

The following procedure takes place when a player lands exactly on or in the "black hole" space. The player who sits to the right of the player who landed on the "black hole" space picks up the "black hole" device, and places one of the plug means 40 into the bottom of one of the apertures to close that aperture. The "black hole" device 30 is then positioned back on the board so that the player who landed on that space does not know which of the apertures has been closed. If desired, the "black hole" device can be rotated so that the player who landed on that spaced must randomly guess which of the apertures is open and which is closed.

The player who landed in the "black hole" space takes one of the insert means 42 which comprises miniature "black hole" spaceships, and drops the spaceship into one of the five apertures in the "black hole" device. If the spaceship is dropped into the aperture which has been plugged, it will not exit the aperture and will remain therein. In that case, the player who landed in the "black hole" and dropped the spaceship is considered stuck in the "black hole" forever and he is penalized by being eliminated from the game. His money is returned to the galactic bank and the planets which he owned, to whatever extent they have been colonized, become the free possessions of whichever player is the first to land on that property.

If the spaceship 42 does pass through the aperture 38 and exits through the bottom thereof, it will be collected in catch means 44 that is positioned beneath the "black hole" device. To add excitement to the game, it is preferable that the spaceship 42 and catch means 44 be formed of materials such as metals that will cause an audible sound to be heard if the spaceship successfully passes through the aperture and drops into the catch means.

The player whose spaceship successfully passes through the "black hole" device 30 is required to pick a "black hole" card (FIG. 7) and follow the instructions. The "black hole" cards provide the player either with penalties (such as payment of money or loss of turn) or with rewards (such as collecting money). After following the instructions on the "black hole" card, the player can at his option place an additional plug means 40 to close another aperture 38 in the "black hole" device. A maximum of 3 of the 5 apertures in the "black hole" device can be closed by plug means 40 throughout the game, so that a player always has at least a 40 percent chance of having a spaceship successfully pass through the "black hole" device 30.

Referring again to FIG. 1, the game board includes a plurality of "space card" positions. There are a total of six "space card" positions, with one or two provided in each galaxy. When a player lands on a "space card" position, he selects the top card from a stack of "space cards" (FIG. 8) which are provided. The player follows the instructions and returns the card to a discard tray (not shown). Most of the space cards provide advantageous instructions, such as the collection of money, or a card which can be held to offset a cost that might be incurred later such as for ship repair, or for free release from the "black hole". Some of the space cards provide for penalties, such as the payment of money to other players or to the bank. The space cards with advantageous results can be held and used at later times when they are helpful.

During the play of the game, if a player throws doubles on the dice, he selects a "beam card" (FIG. 9) and then takes another turn after fulfilling the obligation incurred from where he lands on the first turn. However, a player can only roll twice from one turn as a result of doubles. If the player rolls doubles on the second turn, he moves the appropriate number of spaces and fulfills any obligations incurred, but he takes neither a beam card nor another turn.

The "beam cards" provide a player with an opportunity to strategically move from one galaxy to another. There are three varieties of beam cards. The "beam forward" card permits a player to move forward by one galaxy—e.g., from the third planet of galaxy two to the third planet of galaxy three Similarly, the "beam backward" card enables a player to beam backward by one galaxy—e.g., from the fourth planet of galaxy four to the fourth planet of the third galaxy. However, a player is not permitted to beam forward from the fourth galaxy or to beam back from the first galaxy. Moreover, beaming is only permitted from one numbered planet to another planet of the same number. The "super beam" card allows a player to go either forward or backward by as many galaxies as desired. Thus, a player on the first planet of the first galaxy can beam to the first planet of the second, third or fourth galaxies.

The "beam cards" enable a player to move to an unowned planet, to his own planet, or even to an opponent's planet if he believes it is advantageous (as where an opponent becomes stuck in the "black hole" and his properties will transfer to the first person who lands thereon).

The players can collect the "beam cards" and use them as desired. A player can declare his beam before rolling the dice, proceed to the planet on the other galaxy, follow the instructions that apply from the "beam card" and do what is required by landing on the new planet, return the beam card to the discard tray, and then roll the dice to take his turn. Alternatively, the player can roll the dice, proceed as he is required to do so by moving his token the number of spaces required by the dice, and can then declare a beam before giving up the dice to the next player. The player who has beamed to another galaxy then follows the instructions of the "beam card" and does what is required from landing on the planet.

One of the spaces on the first galaxy is identified as the "time capsule". A player gets into the "time capsule" space either by landing thereon, or by landing on the "go to time capsule" space on the third galaxy, or by following the instructions of a "space card" which might instruct him to go to the "time capsule". If a player lands on the "time capsule" space, he loses one turn. If he is sent to the "time capsule" by landing on the "go to time capsule space" or by the instructions on a "space card", the player can get out of the time capsule only by rolling doubles. The player has three tries, during one turn, to roll doubles. If the player does not roll doubles by the third try, then he must pay 50 galactic money units to the bank, and moves forward the number of spaced shown on the third throw of the dice. If a player is sent to the "time capsule" via a black hole card, he sits out of the game for three turns and then rolls the dice as usual on the fourth turn.

If a player incurs a debt but does not have sufficient money on hand to pay that debt, he can pawn his planet to the galactic bank. This is accomplished by permitting the player to receive one half of the total expansion costs incurred for building upon the planet, in addition to the full value paid for originally purchasing the planet. For example, if a player owns the planet Zuti with cities thereon, the player receives one half of the 100 galactic money units that he spent for building the cities, one half of the galactic money units that he paid for building colonies, and the entire 140 galactic money unit cost of the planet, for a total of 240 galactic money units. The title card to the planet is returned to the bank, but any building markers are left on the property. The next player who lands on the planet can purchase it, together with all buildings thereon, for only the purchase price of the planet. If the player who lands on the planet cannot afford the purchase price, he must then pay the landing cost for that planet to the bank.

The game can be played by two to eight people and has as its object the control of the universe by claiming and colonizing planets. Before the game is started, 1,800 galactic money units are distributed to each player in the form of two 500 unit denominations, four 100 unit denominations, four 50 unit denominations, six 20 unit denominations, five 10 unit denominations and six 5 unit denominations. A determination is then made as to which player will go first and the order in which the other players will follow. This can be accomplished by shaking the dice so that the player who throws the lowest number will go first, the next lowest will go second, and so on.

Each player selects a spaceship playing token (FIG. 3) for traversing the spaces on the playing board. All of these spaceships start from the earth's galaxy, space 12. The first player shakes the two dice, throws them, and moves his spaceship in the direction of the arrows by the number of spaces that are indicated by the dice. After the player has completed his play, the next player throws the dice and conducts his play, the third player follows, and so forth. Two or more spaceships may rest on the same space at the same time.

According to where the spaceship lands, the player will be obligated to do one of the following four alternatives. If a player lands on an unowned planet, energy plant, or spaceship factory, the player must purchase the title to the property if he has that much money. If a player lands on a planet or property that is owned by another player, he pays to the other player the landing cost that is shown on the title card. If a player lands on a "space card" position, he selects the top card from the stack of "space cards" and follows the instructions.

The fourth possibility is for a player to land on his own planet. When this occurs, the player must throw the dice and refer to the "special roll instructions" on the back of the planet title card. The player will either encounter a reward, a penalty or be enabled to colonize his planet, depending on the number that is rolled. After a player has colonized his planet to the maximum by building a space fortress, no additional building can take place. However, the player must still continue to follow the special roll instruction process and obey all other instructions from the title cards.

The players continue to shake the dice, follow the instructions of the game, and work their way along the game board. The players generally advance towards the center of the game board, working their way from the first galaxy to the second, the third and then to the fourth galaxy, and finally to the "black hole". If a player lands on or in the "black hole", the player follows the instructions that have been described hereinabove. If a player hits the "black hole" during the middle part of his move, he continues the count of the dice by resuming on space 12 in the earth's galaxy. Each time a player lands in or passes through the earth's galaxy, he collects 200 galactic money units from the galactic bank.

The last player who is left in the game is the winner. A player is out of the game when he owes more money than he can pay to either the galactic bank or to another player. He then pays whatever he can and returns his title cards to the galactic bank.

From the foregoing, it will be observed that numerous variations and modifications may be effected without departing from the true spirit and scope of the novel concept of the invention. It is to be understood that no limitation with respect to the specific structure illustrated herein is intended or should be inferred. It is, of course, intended to cover by the appended claims all such modifications that fall within the scope of the invention.

I claim:

1. A board game apparatus comprising a playing board having marked spaced defining a path, means associated with said spaces for identifying a value associated therewith, first chance means operable by the players for determining the number of spaced to be traversed, a plurality of pieces representing money, a plurality of said money pieces being allocated to each player before the game commences, means for providing penalties to a player and rewards to a player according to his position on said playing path, and second chance means selectively operable by the players of the game, said second chance means comprising an upstanding member defining a plurality of generally elongated vertical apertures, and means receivable within said apertures for selectively plugging and closing the bottom of at least one of said apertures and insert means receivable in said apertures and being adapted to pass through unplugged ones of said apertures, whereby during play a player is required to place one of said insert means into one of said apertures after at least one of said apertures has been closed by another player with said plug means, said player continuing in said game if said insert means falls completely through an unplugged one of said apertures, and said player being penalized if said insert means remains in a plugged one of the apertures.

2. A game apparatus as defined in claim 1 wherein said marked spaces are positioned in a plurality of generally concentric and continuous path segments, said apparatus further including means for moving said playing token from one path segment to another path segment.

3. A game apparatus as defined in claim 2 wherein said second change means is generally centrally positioned on said playing board and comprises the innermost of said path segments.

4. A game apparatus as defined in claim 1 wherein said playing board defines an opening and said second chance means is received in said opening.

5. A game apparatus as defined in claim 4 wherein support means is positioned beneath said playing board to position said playing board spaced above an underlying surface.

6. A game apparatus as defined in claim 5 wherein catch means is positioned below said opening for catching said insert means when it falls completely through an unplugged aperture.

7. A game apparatus comprising a playing board having marked spaces defining a playing path, including means associated with at least some of said spaces for identifying a value associated therewith, first chance means operable by the players for determining the number of said spaces to be traversed, and second chances means operable by the players for determining the further play of a player, said second chance means comprising an upstanding member defining a plurality of generally elongated vertical apertures, and including means receivable within said apertures operable by another player for selectively closing the bottom of at least one of said apertures in a manner not readily discernible from the top of said upstanding member, insert means receivable in said apertures and being adapted to pass through unclosed ones of said apertures, said apertures being adapted to receive said insert means therein by said one player after at least one of said apertures has been closed by another player, with the further play of said one player determined by whether the one of the apertures into which said insert means are inserted is one of said apertures which is closed by said closing means.

8. A game apparatus as defined in claim 7, wherein said playing board defines an opening adapted to releasably receive said upstanding member.

9. A game apparatus as defined in claim 7, wherein said playing board is adapted to support said second chance means in spaced relation above audible means positionable therebeneath, said audible means being adapted to audibly indicate that said insert means inserted into said second chances means have passed through an unclosed one of said apertures.

* * * * *